US008559838B2

(12) United States Patent
Ogawahara

(10) Patent No.: US 8,559,838 B2
(45) Date of Patent: Oct. 15, 2013

(54) FIXING APPARATUS AND FIXING METHOD

(75) Inventor: Norio Ogawahara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 345 days.

(21) Appl. No.: 12/949,369

(22) Filed: Nov. 18, 2010

(65) Prior Publication Data

US 2011/0318030 A1 Dec. 29, 2011

(30) Foreign Application Priority Data

Jun. 23, 2010 (JP) ..... 2010-142933

(51) Int. Cl.
*G03G 15/20* (2006.01)

(52) U.S. Cl.
USPC ..... 399/69; 399/12

(58) Field of Classification Search
USPC ..... 399/12, 45, 67, 68, 69, 70, 81, 122, 389
See application file for complete search history.

(56) References Cited

U.S. PATENT DOCUMENTS

2004/0136734 A1* 7/2004 Yokobori et al. ..... 399/23

FOREIGN PATENT DOCUMENTS

JP 3959556-32 5/2007

* cited by examiner

*Primary Examiner* — Hoang Ngo
(74) *Attorney, Agent, or Firm* — Sughrue Mion, PLLC

(57) ABSTRACT

An fixing apparatus of the present invention includes: a developer image forming section that is provided to an apparatus main body and forms a developer image on a recording medium; a fixing section that is provided to the apparatus main body and fixes the developer image that has been formed on the recording medium by the developer image forming section; an identification section that is provided to the fixing section and allows a type of recording medium for being fixed by the fixing section to be identified; and a banning section that is provided to the apparatus main body, identifies the type of recording medium for being fixed by the fixing section using the identification section and bans image forming on a recording medium that has a different type from the type of recording medium for being fixed by the fixing section.

9 Claims, 7 Drawing Sheets

FIXING APPARATUS AND FIXING METHOD

CROSS-REFERENCE TO RELATED APPLICATION

This application is based on and claims priority under 35 USC 119 from Japanese Patent Application No. 2010-142933 filed Jun. 23, 2010.

BACKGROUND

Technical Field

The present invention relates to a fixing apparatus and a fixing method.

SUMMARY

The present invention provides a fixing apparatus and a fixing method that can suppress deformation of a recording medium due to fixing.

A fixing apparatus of a first aspect of the present invention includes: a developer image forming section that is provided to an apparatus main body and forms a developer image on a recording medium; a fixing section that is provided to the apparatus main body and fixes the developer image that has been formed on the recording medium by the developer image forming section; an identification section that is provided to the fixing section and allows a type of recording medium for being fixed by the fixing section to be identified; and a banning section that is provided to the apparatus main body, identifies the type of recording medium for being fixed by the fixing section using the identification section and bans image forming on a recording medium that has a different type from the type of recording medium for being fixed by the fixing section.

BRIEF DESCRIPTION OF THE DRAWINGS

Exemplary embodiments of the present invention will be described in detail based on the following figures, wherein.

DETAILED DESCRIPTION

Explanation follows regarding an example of a fixing apparatus according to an exemplary embodiment of the present invention.

Figure 1:
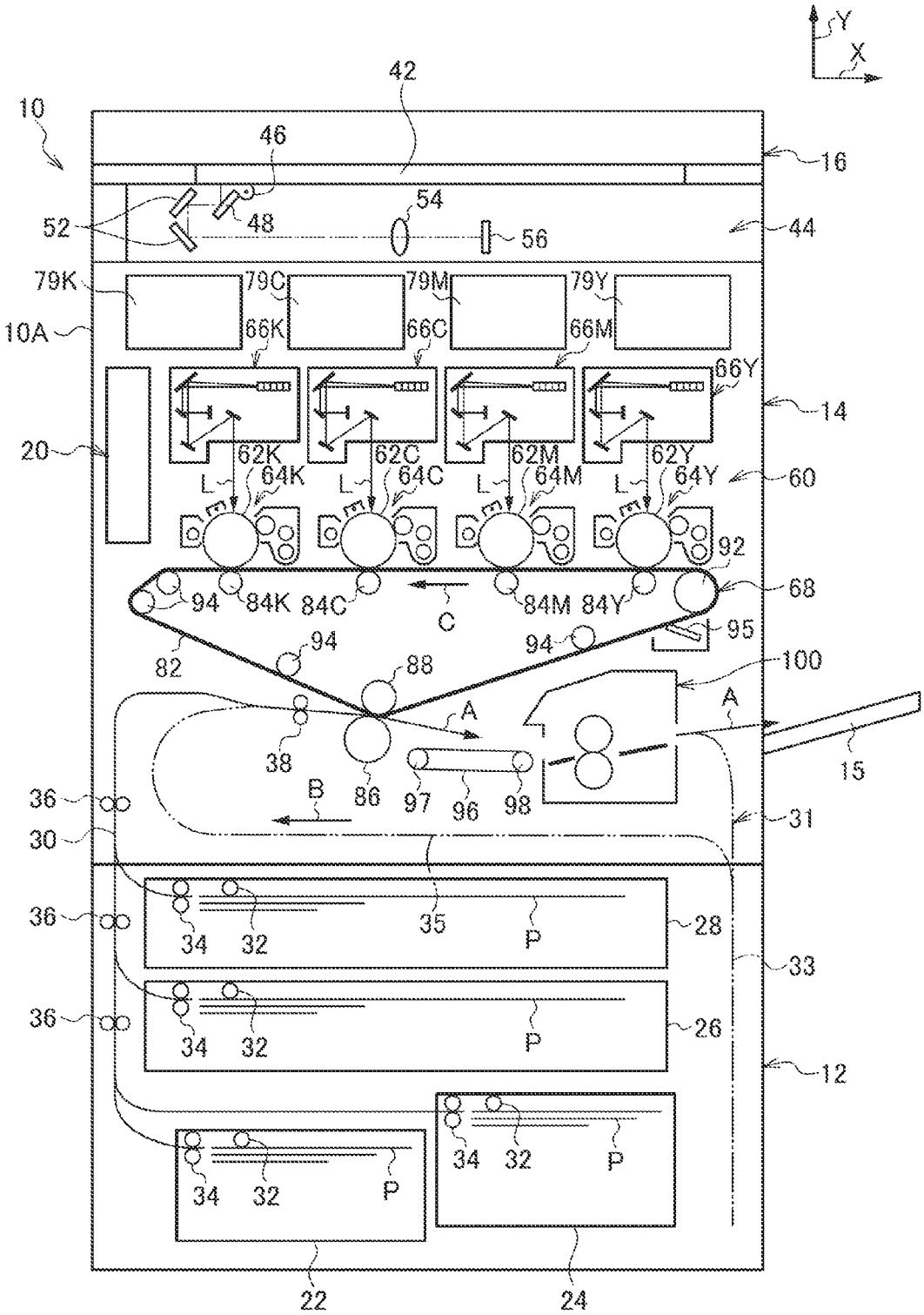
FIG. 1 is an overall configuration diagram according to an exemplary embodiment of the present invention.

FIG. 1 shows an image forming apparatus 10 as an exemplary embodiment. The image forming apparatus 10 is configured including, from the bottom towards the top in the vertical direction (direction of arrow Y): a paper housing section 12 that houses plural types of recording paper P; a main operation section 14 provided above the paper housing section 12 and performing image forming on the recording paper P, serving as an example of a recording medium, supplied from the paper housing section 12; an original scanning section 16 provided above the main operation section 14 for scanning an original (not shown in the drawings); and a control section 20, serving as an example of a banning section, provided in the main operation section 14, controlling operation of each section of the image forming apparatus 10 and also. In the following explanation, the vertical direction of an apparatus main body 10A of the image forming apparatus 10 is referred to as the arrow Y direction, and the horizontal direction is referred to as the arrow X direction.

The paper housing section 12 is provided with a first housing section 22, a second housing section 24, a third housing section 26 and a fourth housing section 28, in which different sizes of recording paper P are housed. The housed recording paper P is fed out one sheet at a time by feed rolls 32 provided in the first housing section 22, the second housing section 24, the third housing section 26 and the fourth housing section 28, respectively. The recording paper P that has been fed out is then conveyed to a conveying path 30 provided within the image forming apparatus 10 by conveying rolls 34 provided in the first housing section 22, the second housing section 24, the third housing section 26 and the fourth housing section 28, respectively.

Pairs of conveying rolls 36 for conveying the recording paper P one sheet at a time are respectively provided on the conveying path 30 downstream of the conveying rolls 34. Positioning rolls 38 for performing positional alignment are provided on the conveying path 30 downstream of the conveying rolls 36 in the recording paper P conveying direction, for temporarily stopping the recording paper P and feeding the recording paper P out to a secondary transfer position, described below, at a particular timing.

The upstream portion of the conveying path 30, as viewed from the front face of the image forming apparatus 10, is provided in a straight line along the arrow Y direction from the left hand side of the paper housing section 12 to a left hand side lower portion of the main operation section 14. The downstream portion of the conveying path 30 is provided from the left hand side lower portion of the main operation section 14 up to a paper discharge section 15 provided at the right hand face of the main operation section 14. A double-sided conveying path 31 is connected to the conveying path 30, for conveying and reversing the recording paper P in order to perform image forming on both sides of the recording paper P. The conveying direction of the recording paper P when not performing double-sided conveying is shown by arrow A.

The double-sided conveying path 31 has, when viewed from the front face of the image forming apparatus 10, a reversing section 33 provided in a straight line along the arrow Y direction from a right hand side lower portion of the main operation section 14 to the right hand side of the paper housing section 12, and a conveying section 35 that conveys the recording paper P towards the left hand side in the drawing (the arrow B direction) so that the trailing edge of the recording paper P conveyed into the reversing section 33 is leading. The downstream end portion of the conveying section 35 is connected by a guide member (not shown in the drawings) to a position on the conveying path 30 upstream of the positioning rolls 38. Note that in FIG. 1, there are plural conveying rolls provided at intervals in the reversing section 33 and the conveying section 35; however they are omitted from the drawings. A switching member that switches between the conveying path 30 and the double-sided conveying path 31, and a switching member that switches between the reversing section 33 and the conveying section 35 are also omitted in the drawings.

The original scanning section 16 is provided with a platen glass 42 on which a single sheet original is placed, and an original scanning device 44 that scans the original placed on the platen glass 42. The original scanning device 44 includes: a light illumination section 46 that illuminates light onto the original placed on the platen glass 42; a single full rate mirror 48 and two half rate mirrors 52 that reflect light that has been illuminated by the light illumination section 46 and reflected from the original, reflecting this light so as to fold back in a direction parallel to the platen glass 42; an imaging lens 54 into which reflected light folded by the full rate mirror 48 and the half rate mirrors 52 is introduced; and a photoelectric converter element 56 that converts the reflected light focused by the imaging lens 54 into an electrical signal. The electrical signal converted by the photoelectric converter element 56 is image processed by an image processing device (not shown in the drawings) for use in image forming. Configuration is made such that the full rate mirror 48 moves along the platen glass 42 at a full rate, and the half rate mirrors 52 move along the platen glass 42 at half the rate.

The main operation section 14 includes: an image forming section 60 that is provided within the apparatus main body 10A and serves as an example of a developer image forming section for forming a toner image (developer image) on recording paper P; and a fixing device 100 that serves as an example of a fixing section for fixing the developer image formed on the recording paper P by the image forming section 60, with the fixing device 100 capable of being installed to the apparatus main body 10A and detached from the apparatus main body 10A.

The image forming section 60 is configured including: image forming units 64K, 64C, 64M, 64Y that have photoreceptors 62K, 62C, 62M, 62Y provided corresponding to each toner, these being yellow (Y), magenta (M), cyan (C) and black (K) and serving as examples of developer; exposing units 66K, 66C, 66M, 66Y that emit light beams L towards the outer peripheral face of the photoreceptors 62K, 62C, 62M, 62Y to perform light exposure thereon; and a transfer unit 68 that transfers the images formed by the image forming units 64K, 64C, 64M, 64Y onto the recording paper P. In the explanation that follows, the suffices Y, M, C, K will be appended after reference numerals in the explanation when discrimination needs to be made between Y, M, C, K. However the suffixes Y, M, C, K will be omitted when configuration is similar and discrimination between Y, M, C, K is not required.

The exposing units 66 are each configured to use a rotating multi-faceted mirror (polygon mirror: no reference numeral) to scan a light beam emitted from a light source (not shown in the drawings), reflecting the light beam L with plural optical components including reflecting mirrors, and emitting the light beam L corresponding to each toner towards the respective photoreceptor 62. The photoreceptors 62 are provided in the arrow Y direction below the exposing units 66.

Figure 2:
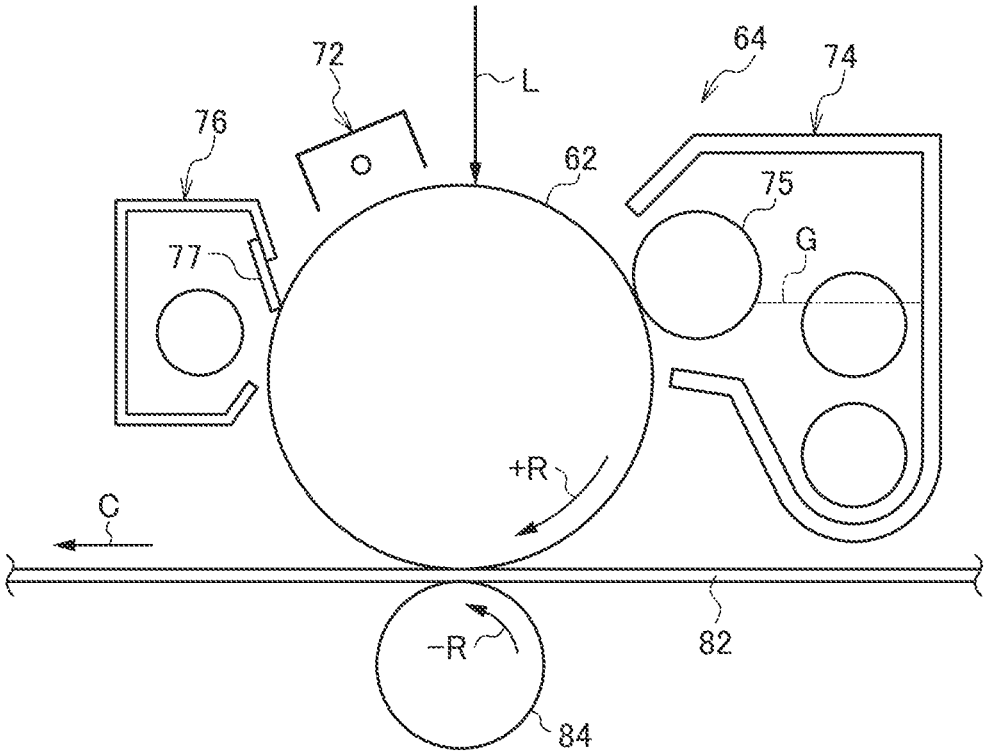
FIG. 2 is a configuration diagram of an image forming unit according to an exemplary embodiment of the present invention.

As shown in FIG. 2, each the image forming units 64 is configured including the photoreceptor 62, provided so as to be rotatable in the arrow +R direction (the clockwise direction in the drawing), and with a charging device 72, a developing device 74, and a cleaning unit 76 disposed facing the outer peripheral face of the photoreceptor 62, in sequence from upstream to downstream. The charging device 72 and the developing device 74 are disposed such that the light beam L is illuminated onto the outer peripheral face of the photoreceptor 62 at a position between the charging device 72 and the developing device 74. An intermediate transfer belt 82, described below, contacts the outer peripheral face of the photoreceptors 62 at a position between the developing device 74 and the cleaning unit 76.

The photoreceptor 62 is configured by a electrically conductive and earthed circular cylindrical shaped base member (not shown in the drawings), with a surface layer (not shown in the drawings) on the outer peripheral face of the base member, including a charge generation layer, a charge transport layer, and a protection layer, layered in sequence in the outwards radial direction. The photoreceptor 62 is rotatable in the arrow +R direction (the clockwise direction in the drawing) by driving with a motor (not shown in the drawings). The charging device 72 is, as an example thereof, configured by a corotron charging unit that charges the outer peripheral face of the photoreceptor 62 with the same polarity as that of toner by applying a voltage to a wire and inducing corona discharge. A latent image (electrostatic latent image) is formed by illuminating the light beam L onto the charged outer peripheral face of the photoreceptor 62.

The developing device 74 is, as an example thereof, provided with a developer sleeve 75 containing developer G, made up from carrier particles formed from magnetic bodies mixed in with toner. Magnets are provided on the inside of the developer sleeve 75 for forming plural magnetic poles. Due to the developer sleeve 75 rotating and thereby forming a magnetic brush at a position facing towards the photoreceptor 62, and due to application of a developing bias to the developer sleeve 75 with a voltage application unit (not shown in the drawings), the developing device 74 makes the latent image on the outer peripheral face of the photoreceptor 62 visible with toner, and forms a toner image (developer image). Configuration is made such that toner is fed to the developing devices 74 from toner cartridges 79 (see FIG. 1) provided above the image forming section 60.

Each of the cleaning units 76 includes a cleaning blade 77 disposed with its leading end side facing against the rotation direction of the photoreceptor 62 and making contact with the outer peripheral face of the photoreceptor 62. Hence configuration is such that toner remaining on the outer peripheral face of the photoreceptor 62 after transfer is scraped off by the cleaning blade 77 and collected. The intermediate transfer belt 82 is provided further downstream than the developing device 74 in the photoreceptor 62 rotation direction, and performs primary transfer of the toner image developed by the developing device 74.

As shown in FIG. 1, the transfer unit 68 is configured including: the intermediate transfer belt 82; primary transfer rolls 84 that primary transfer toner images from the photoreceptors 62 onto the intermediate transfer belt 82; a secondary transfer roll 86 that secondary transfers the toner images that have been superimposed in sequence on the intermediate transfer belt 82 onto the recording paper P; and an auxiliary roll 88.

The intermediate transfer belt 82, as an example thereof, is configured as a film shaped endless belt in which carbon black (an electrostatic charge prevention agent) has been included in a resin, such as, for example, a polyimide or a polyamide. Inside the intermediate transfer belt 82 are disposed: a drive roll 92, disposed in the vicinity of the image forming unit 64Y and the primary transfer roll 84Y and rotationally driven by a motor (not shown in the drawings); and plural rotatably provided conveying rolls 94. The intermediate transfer belt 82 is entrained around the primary transfer rolls 84K, 84C, 84M, 84Y, the drive roll 92, the conveying rolls 94, and the auxiliary roll 88. Thus, when the drive roll 92 is rotated in the anticlockwise direction as viewed in the drawing, the intermediate transfer belt 82 circulates in the arrow C direction (the anticlockwise direction as viewed in the drawing).

The primary transfer roll 84, as an example thereof, is configured with a sponge layer (not shown in the drawings) formed around the periphery of a circular column shaped shaft configured from a metal, such as, for example, stainless steel, with portions at both end of the shaft supported by bearings so as to be rotatable. The primary transfer roll 84 is configured such that a voltage of the opposite polarity to that of the toner is applied to the shaft from a power supply (not shown in the drawings).

The secondary transfer roll 86, as an example thereof, is configured similarly to the primary transfer rolls 84, and is rotatably disposed on the conveying path 30 at the downstream side of the positioning rolls 38. The secondary transfer roll 86 makes contact with the outer peripheral face of the intermediate transfer belt 82, so as to nip the intermediate transfer belt 82 between itself and the auxiliary roll 88. The secondary transfer roll 86 is earthed.

The auxiliary roll 88 is applied with a secondary transfer voltage through a electric supply roll (not shown in the drawings) formed from metal and disposed so as to make contact with the outer peripheral face of the auxiliary roll 88, and forms an opposing electrode to the secondary transfer roll 86. The secondary transfer voltage is applied to the auxiliary roll 88, and due to a potential difference generated between the auxiliary roll 88 and the secondary transfer roll 86, the toner image on the intermediate transfer belt 82 is secondary transferred onto the recording paper P conveyed into the contact portion of the secondary transfer roll 86 and the intermediate transfer belt 82.

A cleaning blade 95 is provided at a position facing the outer peripheral face of the intermediate transfer belt 82 in the vicinity of the drive roll 92, for removing toner or paper dust remaining on the intermediate transfer belt 82 after secondary transfer. Note that, as an example, a seal member (not shown in the drawings) for reflecting light is fixed at a reference position in a non-transfer region on the outer peripheral face of the intermediate transfer belt 82, where a toner image is not transferred. A position sensor (not shown in the drawings) is provided at a position that can face the seal member, for detecting the reference position on the intermediate transfer belt 82 by illuminating light onto the non-transfer region of the intermediate transfer belt 82 and receiving light reflected by the seal member. Due thereto, the image forming operation of each of the sections is performed in the image forming section 60 based on a signal of the reference position obtained by the position sensor.

A conveyor belt 96 is provided further downstream than the secondary transfer roll 86 in the movement direction of the recording paper P, for conveying the recording paper P that has completed toner image secondary transfer to a fixing device 100, described below. The conveyor belt 96 is provided so as to be capable of circulatory movement due to a drive unit, including a support roll 97, a drive roll 98, a motor and gears (not shown in the drawings), so as to convey the recording paper P towards the fixing device 100.

A rail shaped guide member (not shown in the drawings) is provided in the image forming apparatus 10 below the conveyor belt 96 at the right hand side, with the guide member capable of being pulled out, in the direction out of the page in the drawing. The fixing device 100 is placed on the guide member when it has been pulled out, and is installed to the apparatus main body 10A by being pushed in, in the direction into the page in the drawing. In order to take the fixing device 100 out of the apparatus main body 10A, the guide member and the fixing device 100 are pulled in the direction out of the page in the drawing, and then the fixing device 100 is moved upwards so as to be taken out.

Explanation now follows regarding an example of the fixing device 100.

Figure 3:
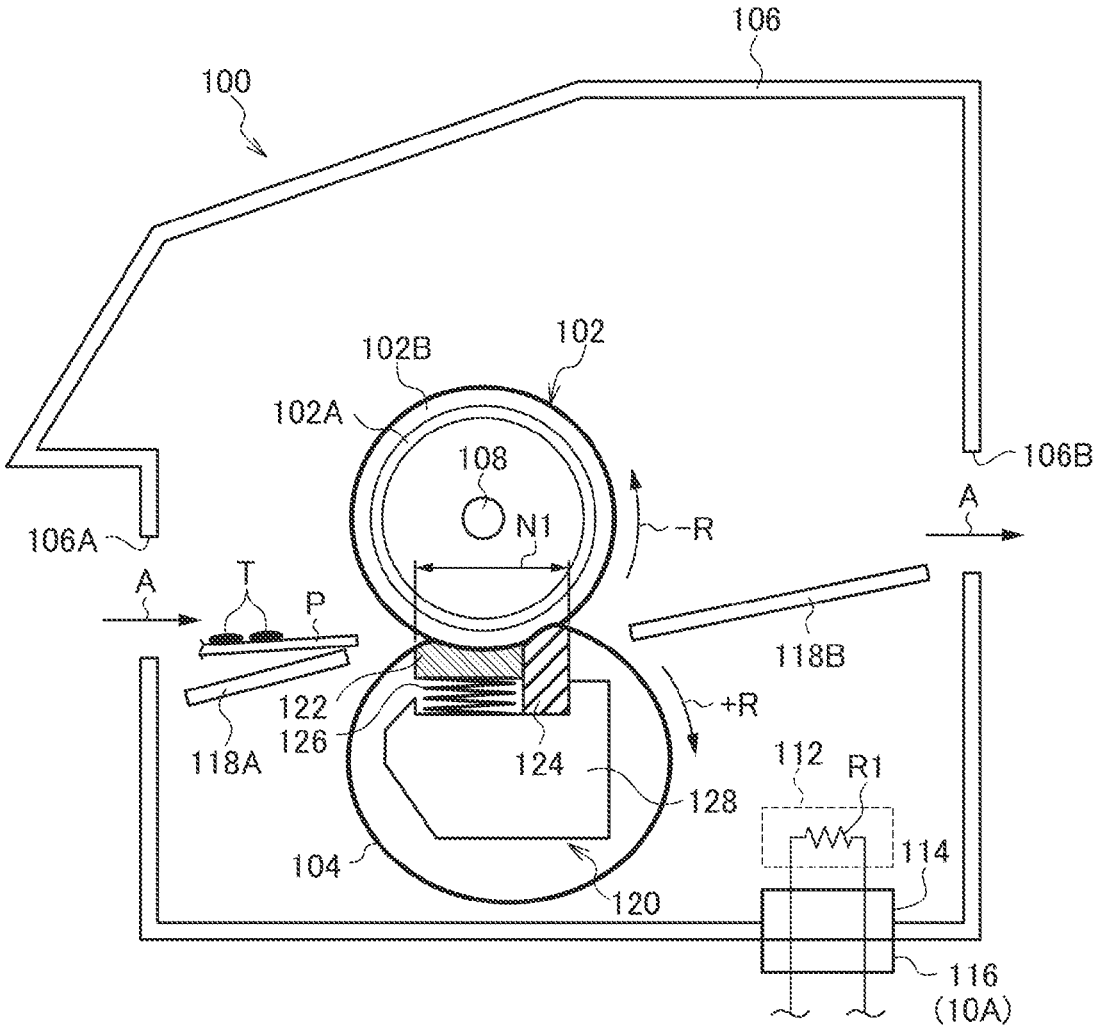
FIG. 3 is a configuration diagram of a standard type fixing device according to an exemplary embodiment of the present invention.

As shown in FIG. 3, the fixing device 100 is configured including: a case 106 configuring a fixing device main body; a fixing roll 102 provided inside the case 106 for fixing a toner image T to the recording paper P; an endless shaped belt member 104 that makes contact with the outer peripheral face of the fixing roll 102; and a press section 120 provided inside the belt member 104, for pressing the belt member 104 towards the outer peripheral face of the fixing roll 102. A temperature sensor for detecting the temperature of the fixing roll 102 is omitted in FIG. 3.

The case 106 is formed with an opening 106A in the left hand side wall in the drawing, an opening 106B formed in the right hand side wall, with the size of the openings 106A, 106B large enough to enable the recording paper P to pass through. Guide members 118A, 118B are provided before and after the fixing roll 102 in the conveying direction of the recording paper P (at the left and right in the drawing) for guiding the recording paper P. Accordingly, configuration is such that the recording paper P on which the toner image T is in a non-fixed state is introduced from the opening 106A and guided by the guide member 118A, and the recording paper P on which the toner image T has been fixed by the fixing roll 102 is guided by the guide member 118B to be discharged the opening 106B.

A resistor 112 is provided to the case 106 and serves as an example of an identification unit for letting the control section 20 (see FIG. 1) identify plural types of the fixing device 100 when the fixing device 100 is installed in the apparatus main body 10A. The fixing device 100, as an example thereof, is a fixing device in which the type of recording paper P not banned from being fixed is mainly normal paper, with this being referred to as a standard type. The resistance value of the resistor 112 is set at R1 in order to be identified as standard type.

The resistor 112 is connected by wiring to terminals (not shown in the drawings) in two locations of the connector 114 provided at the far side of the case 106 in the drawing. The connector 114 is configured for connection to a connector 116 provided inside the apparatus main body 10A. The connector 116 is connected by wiring to a resistance detector 132 (see FIG. 5) that serves as an example of a banning section, described later. Note that while the connector 114 is provided on the far side of the case 106, it is shown for convenience at a lower portion of the case 106 in FIG. 3.

The fixing roll 102 is, as an example thereof, configured including a circular cylindrical metal core 102A, with a resilient layer 102B covering the outer peripheral face of the metal core 102A, and a release layer (not shown in the drawings) formed from a fluoro-resin covering the outer peripheral face of the resilient layer 102B. A halogen lamp 108 is provided as an example of a heat source inside the metal core 102A. Examples of materials for configuring the metal core 102A include, for example, a metal, such as aluminum, SUS, iron, copper, brass or the like, an alloy or the like. Examples of materials for configuring the resilient layer 102B include, for example, a silicone rubber.

The belt member 104, as an example thereof, is configured from an endless shaped base material formed from a polyimide, covered with a fluoro-resin on the surface of the base material. The outer peripheral face of the belt member 104 is disposed so as make contact with the fixing roll 102 along the rotation axis direction, with the axial directions of the fixing roll 102 and the belt member 104 along the same direction.

The fixing roll 102 and the belt member 104 are rotationally driven such that their rotation directions are opposite directions to each other. Accordingly, in the region where the fixing roll 102 and the belt member 104 make contact with each other (referred to below as the press region) a state is achieved in which movement is in the same direction. For example, since the fixing roll 102 is rotated in the arrow −R direction (the anticlockwise direction in the drawing) and the belt member 104 is rotated in the arrow +R direction (the clockwise direction in the drawing), recording paper P that has been conveyed to the press region is nipped between the fixing roll 102 and the belt member 104 and conveyed in the arrow A direction by rotation of the fixing roll 102 and the belt member 104. The width of the press region along the left-right direction in FIG. 3 (a direction orthogonal to the rotation axis direction of the fixing roll 102) is denoted press width N1.

The press section 120 is configured including: a first press member 122 disposed in the press region at the recording paper P conveying direction (arrow A direction) upstream side and pressing the belt member 104 towards the fixing roll 102; a second press member 124 disposed at the arrow A direction downstream side and pressing the belt member 104 towards the fixing roll 102; and a holder 128. Note that, as an example, the press width in the press region due to the first press member 122 is greater than the press width due to the second press member 124, and the sum of the press width of the first press member 122 and the press width of the second press member 124 is N1.

The first press member 122, as an example thereof, is configured from silicone rubber in an elongated shape with length along the axial direction of the belt member 104, disposed alongside and at the arrow A direction upstream side of the second press member 124. The first press member 122 is also biased by a spring 126 provided at an upper portion of the holder 128 towards the inner peripheral face of the belt member 104, pressing the belt member 104 against the outer peripheral face of the fixing roll 102.

The second press member 124, as an example thereof, is formed from a liquid crystal polymer in a rectangular block shape of elongated shape with length along the axial direction of the belt member 104, and fixed to the top face of the holder 128. The second press member 124 makes contact with the inner peripheral face of the belt member 104 and presses the belt member 104 against the outer peripheral face of the fixing roll 102. The press region imparts a deformation to the outer peripheral face of the fixing roll 102 due to the locally formed protruding portion at the second press member 124, with large local deformation of the fixing roll 102. Thus, due to the large local deformation of the fixing roll 102 a capability to release the recording paper P is obtained with a relatively smaller deformation amount in comparison to a configuration in which deformation is induced over the entire press region, as in fixing system using a pair of rollers.

Explanation now follows regarding a cardboard-type fixing device 150 and an envelope-type fixing device 160, which differ from the standard type fixing device 100. Portions using similar components to those of the fixing device 100 are allocated the same reference numerals as in the fixing device 100 and explanation thereof is omitted.

Figure 4A:
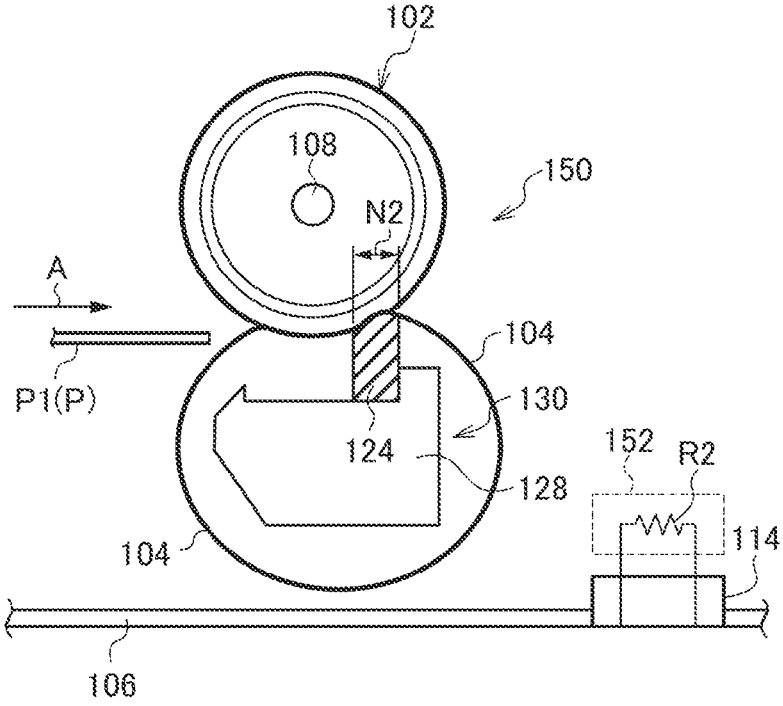
FIG. 4A is a schematic diagram showing a method for identifying the type of the fixing device according to an exemplary embodiment of the present invention.

FIG. 4A shows a fixing device 150. The fixing device 150 is provided with a press section 130 in place of the press section 120 of fixing device 100 (see FIG. 3). The press section 130 is of a configuration in which the first press member 122 and the spring 126 (see FIG. 3) have been removed, and pressing is only performed by the second press member 124. Accordingly, the press width of the press region of the fixing device 150 is a press width N2 formed by the second press member 124 alone, with this being smaller than the press width N1 in the fixing device 100. Moreover, since the first press member 122 is not present, the pressure at the position where the recording paper P is introduced to the press region is lower than that of the fixing device 100.

The fixing device 150 here, as in the described operation below, does not easily induce deformation during fixing of cardboard; however, since deformation from the second press member 124 remains if employed to fix normal paper, the fixing device 150 is not applicable for fixing normal paper. In addition, since creasing occurs from deformation by the second press member 124 if employed to fix envelopes, the fixing device 150 is not applicable for fixing of envelopes. Due thereto, since the fixing device 150 is a fixing device in which the type of recording paper P not banned from being fixed is mainly cardboard, it is referred to as a cardboard-type.

The fixing device 150 is provided with a resistor 152, serving as example of an identification unit, for the control section 20 (see FIG. 1) to identify the type of the fixing device 150 when the fixing device 150 has been installed in the apparatus main body 10A. In order to identify cardboard-type the resistance value of the resistor 152 is set as R2, this being different from R1.

Figure 4B:
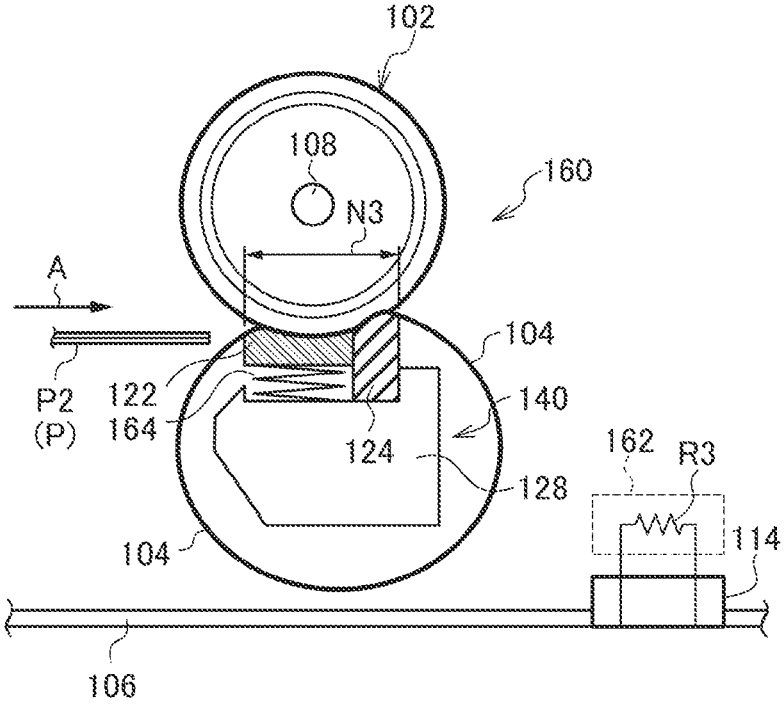
FIG. 4B is a schematic diagram showing a method for identifying the type of the fixing device according to an exemplary embodiment of the present invention.

FIG. 4B shows a fixing device 160. The fixing device 160 is provided with a press section 140 in place of the press section 120 of fixing device 100 (see FIG. 3). The press section 140 is of a configuration in which a spring 164, of smaller biasing force than the spring 126, is provided in place of the spring 126 (see FIG. 3). Accordingly, the press width of the press region of the fixing device 160 is a press width N3 just slightly smaller than the press width N1 in the fixing device 100, and the pressure at the position where the recording paper P is introduced to the press region is greater than that of the fixing device 150 but lower than that of the fixing device 100.

The fixing device 160 here, as described in the operation below, does not easily induce creasing during fixing of envelopes; however, since deformation from the second press member 124 becomes greater than deformation due to the first press member 122 when fixing ordinary paper or cardboard, the fixing device 160 is not applicable for fixing normal paper or cardboard. Due thereto, since the fixing device 160 is a fixing device in which the type of recording paper P not banned from being fixed is mainly envelopes, it is referred to as an envelope-type.

The fixing device 160 is provided with a resistor 162, serving as an example of an identification unit, for the control section 20 (see FIG. 1) to identify the type of the fixing device 160 when the fixing device 160 has been installed in the apparatus main body 10A. In order to identify envelope-type, the resistance value of the resistor 162 is set as R3, this being different from R1 and R2.

Explanation now follows regarding the identification method of the fixing devices 100, 150, 160.

Figure 5:
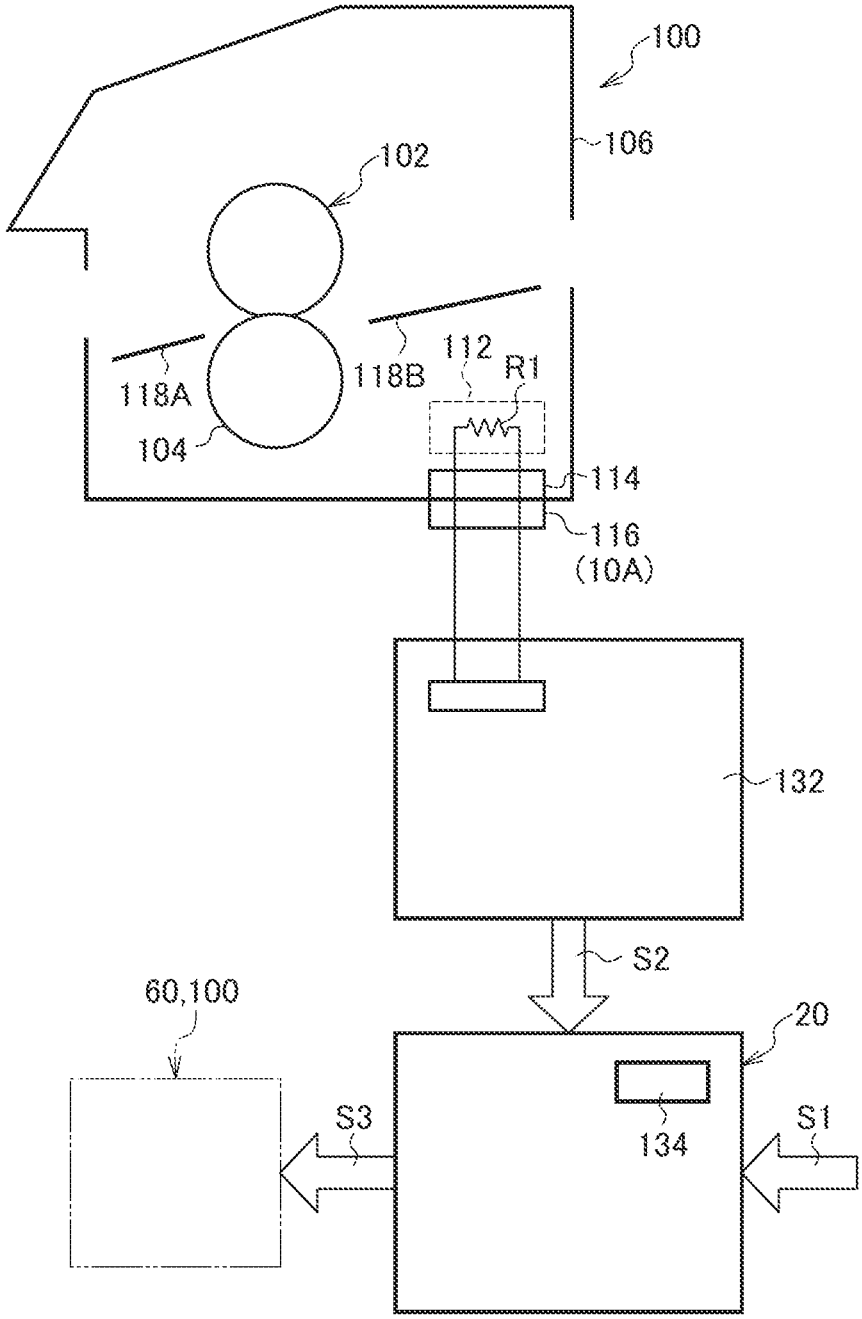
FIG. 5 is a schematic diagram showing a cardboard-use fixing device and an envelope-use fixing device according to an exemplary embodiment of the present invention.

FIG. 5 shows, as an example, the connector 114 of the fixing device 100 in a connected state to the connector 116 of the apparatus main body 10A. The connector 116 is connected through wiring to the resistance detector 132, and the resistance detector 132 is connected through wiring to the control section 20. The control section 20 is configured so as to transmit a selection signal S1 relating to the type of recording paper P selected by an external device, such as a personal computer (not shown in the drawings) or the like or an operation panel 138 (see FIG. 7), described below, and an identification signal S2 of the resistor 112 (resistance value R1) of the fixing device 100 detected by the resistance detector 132. The control section 20, transmits instructions to each section, including the image forming section 60 and the fixing device 100, in order to control the operation of each section, and transmits an instruction signal S3 to stop operation of the image forming section 60 and the fixing device 100.

signal S2, the control section 20 outputs an instruction signal S3 banning operation of the image forming section 60 and the installed fixing device, so as to stop operation of the image forming section 60 with this fixing device.

Note that while in the present exemplary embodiment the operation of both the image forming section 60 and the installed fixing device is stopped, since fixing may not be performed by the fixing device corresponding to recording paper P of another type, configuration may be made such that operation of the image forming section 60 at the upstream side of the image forming process alone is stopped, or operation of the installed fixing device alone is stopped. Namely, configuration may be made such that operation of at least one of the image forming section 60 and/or the fixing device is stopped.

Table 1 shows a list of the type of recording paper P compatible with the fixing devices 100, 150, 160, respectively. In the present exemplary embodiment, as an example, there are 7 types of recording paper P set, these being normal paper, recycled paper, cardboard, OHP (sheets), film, coated paper and envelopes, with two different thickness A, B (thickness A<B) set for normal paper, recycled paper, cardboard, film and coated paper, respectively.

TABLE 1

| | TYPE OF FIXING DEVICE | | |
|---|---|---|---|
| TYPE OF RECORDING PAPER | STANDARD TYPE (FIXING DEVICE 100) | CARDBOARD COMPATIBLE (FIXING DEVICE 150) | ENVELOPE COMPATIBLE (FIXING DEVICE 160) |
| NORMAL PAPER A | NOT BANNED | USE BANNED | USE BANNED |
| NORMAL PAPER B | NOT BANNED | USE BANNED | USE BANNED |
| RECYCLED PAPER A | NOT BANNED | USE BANNED | USE BANNED |
| RECYCLED PAPER B | NOT BANNED | USE BANNED | USE BANNED |
| CARDBOARD A | NOT BANNED | NOT BANNED | USE BANNED |
| CARDBOARD B | NOT BANNED | NOT BANNED | USE BANNED |
| OHP | NOT BANNED | USE BANNED | USE BANNED |
| FILM A | NOT BANNED | USE BANNED | USE BANNED |
| FILM B | NOT BANNED | USE BANNED | USE BANNED |
| COATED PAPER A | NOT BANNED | NOT BANNED | USE BANNED |
| COATED PAPER B | NOT BANNED | NOT BANNED | USE BANNED |
| ENVELOPE | USE BANNED | USE BANNED | NOT BANNED |

The resistance detector 132 includes a supply circuit (not shown in the drawings) for supplying current to the resistor 112, and a voltmeter (not shown in the drawings) for measuring the voltage between the two ends of the resistor 112. The resistance detector 132 derives the resistance value of the resistor 112 from a fixed current value supplied by the supply circuit and the voltage value measured by the voltmeter. Since the resistance value R1 is set for the fixing device 100, the resistance value R2 is set for the fixing device 150, and the resistance value R3 is set for the fixing device 160, the resistance detector 132 identifies the type of the fixing device from the resistance value obtained, and transmits an identification signal S2 to the control section 20.

The control section 20 compares the type of recording paper P corresponding to the selection signal S1 and the type of recording paper P not banned from being fixed by the fixing device corresponding to the identification signal S2, and when there is a match between these two types, the control section 20 outputs an instruction signal S3 permitting operation of the image forming section 60 and the installed fixing device, so as to operate the image forming section 60 with this fixing device. However, for cases in which the type of recording paper P corresponding to the selection signal S1 does not match the type of recording paper P not banned from being fixed by the fixing device corresponding to the identification As can be seen from Table 1, the standard type fixing device 100 is compatible with normal paper A, B, recycled paper A, B, OHP, film A, B and coated paper A, B from the types of recording paper P. The cardboard compatible fixing device 150 is compatible with cardboard A, B and coated paper A, B from the type of recording paper P. The envelope compatible fixing device 160 only is compatible with envelopes from the types of recording paper P.

Note that a counter 134 and a memory (not shown in the drawings) are provided in the control section 20. The counter 134 is configured so as to accumulate the count of the number of fixed sheets for the fixing devices 100, 150, 160, respectively, such that, for example, when the fixing device 150 has been exchanged for the fixing device 100, the accumulated value up to exchange of the fixing device 100 is saved in the memory, and the number of sheets of the recording paper P fixed by the fixing device 150 is counted, accumulated and saved in the memory.

Explanation now follows regarding operation of the present exemplary embodiment.

In FIG. 1, when power supply to the image forming apparatus 10 is in the ON-state, the resistance detector 132 of the image forming apparatus 10 (see FIG. 5) detects the resistance value of the fixing device that is installed in the apparatus main body 10A. As an example thereof, when the fixing device 100 is installed to the apparatus main body 10A, the selection signal S1 is a signal corresponding to normal paper.

Then, the control section 20 identifies that the fixing device 100 is installed from the resistance value R1 detected with the resistance detector 132 (see FIG. 3). Moreover, the control section 20 identifies the type of recording paper P to be normal paper based on the transmitted selection signal S1 (normal paper in this case), compares the selection signal S1 with the identification signal S2, and identifies that both are set at normal paper. The control section 20 permits operation of the image forming section 60 and the fixing device 100, and image forming operation in each section of the image forming apparatus 10 is started.

However, in cases in which the type of recording paper P instructed and the type of recording paper P compatible with the fixing device are different from each other, for example, when the selection signal S1 is cardboard or envelopes when the fixing device 100 is in an installed state (the identification signal S2 is normal paper), miss-fixing of cardboard and envelopes is avoided by to the control section 20 banning operation of the image forming section 60 and the fixing device 100.

As shown in FIG. 1, in the image forming apparatus 10 the outer peripheral faces of each of the photoreceptors 62 are charged by the charging devices 72 and exposure is performed with the light beam L emitted from each of the exposing units 66 according to image data, forming electrostatic latent images thereby. The electrostatic latent image formed on the outer peripheral face of each of the photoreceptors 62 is then developed by each of the developing device 74 as a toner image for each of the respective colors, yellow (Y), magenta (M), cyan (C) and black (K).

Each of the toner images formed on the surface of each of the photoreceptors 62 is then successively superimposed and transferred onto the intermediate transfer belt 82 by each of the primary transfer rolls 84. The superimposed and transferred toner images on the intermediate transfer belt 82 are then secondary transferred by the secondary transfer roll 86 and the auxiliary roll 88 onto the recording paper P arriving conveyed along the conveying path 30.

The recording paper P onto which the toner images have been transferred is then conveyed by the conveyor belt 96 towards the fixing device 100. The toner images on the recording paper P are then fixed in the fixing device 100 onto the recording paper P by heat and pressure. The recording paper P to which the toner images have been fixed is then, as an example thereof, discharged from the paper discharge section 15. A cycle of image forming processing is thereby performed. Note that after performing image fixing to the front face of the fixing device 100, in order to form a toner image on the non-imaged face not formed with an image (in double sided image forming), the recording paper P is conveyed into the double-sided conveying path 31 and image forming and fixing is performed to the back face of the recording paper P.

As shown in FIG. 3, in the fixing device 100, when the recording paper P is introduced into the press region where the fixing roll 102 and the belt member 104 make contact with each other, due to the recording paper P being deformed downwards by the protrusion shape from pressing by the first press member 122, and being deformed upwards by the protrusion shape due to pressing from the second press member 124, the deformation directions are opposite and cancel each other out, so that there is little amount of deformation when discharged from the press region. The amount of curl of the recording paper P is thereby reduced.

Figure 6A:
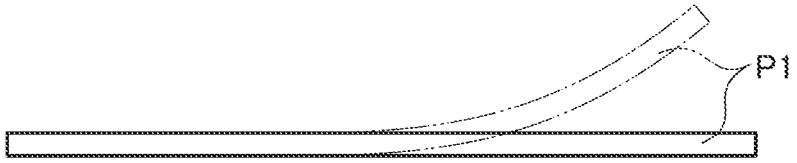
FIG. 6A is a schematic diagram showing a state when cardboard has been fixed in two different types of fixing device and a curl occurs.
Figure 6B:
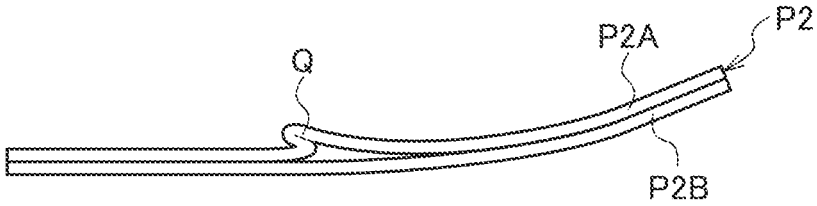
FIG. 6B is a schematic diagram showing a state when an envelope has been fixed in a standard type of fixing device and a crease occurs.

As a comparative example, if cardboard were to be fixed using the fixing device 100, particularly due to strong pressing on the cardboard in the press region from the first press member 122, the curl amount of the cardboard P1 is large, as shown by the double-dot broken lines in FIG. 6A. In addition, if envelopes were to be fixed using the fixing device 100, particularly due to strong pressing on the envelopes in the press region due to the first press member 122, as shown in FIG. 6B, slip occurs between movement of the top side P2A and the bottom side P2B of the envelope P2 along the direction of travel. This results in a crease Q occurring in the envelope P2 discharged from the press region.

Explanation now follows regarding operating when using the fixing device 150.

In FIG. 1, when power supply to the image forming apparatus 10 is in the ON-state, the resistance detector 132 of the image forming apparatus 10 (see FIG. 5) detects the resistance value of the fixing device that is installed in the apparatus main body 10A. As an example thereof, when the fixing device 150 is installed to the apparatus main body 10A, the selection signal S1 is a signal corresponding to cardboard.

Then, the control section 20 identifies that the fixing device 150 is installed by detecting resistance value R2 with the resistance detector 132 (see FIG. 4A). Moreover, the control section 20 identifies the type of recording paper P to be cardboard based on the transmitted selection signal S1 (cardboard), compares the selection signal S1 with the identification signal S2, and identifies that both are set at cardboard. The control section 20 permits operation of the image forming section 60 and the fixing device 150 (see FIG. 4A), and image forming operation in each section of the image forming apparatus 10 is started.

However, in cases in which the type of recording paper P instructed and the type of recording paper P compatible with the fixing device are different from each other, for example, when the selection signal S1 is normal paper or envelopes and the fixing device 150 is in an installed state (the identification signal S2 is cardboard), miss-fixing of normal paper and envelopes is avoided by the control section 20 banning operation of the image forming section 60 and the fixing device 150.

As shown in FIG. 1, charging, exposing, developing, primary transfer, and secondary transfer are performed similarly to as described above, and the cardboard P1 to which the toner image has been transferred (see FIG. 4A) is conveyed towards the fixing device 150 by the conveyor belt 96. In the fixing device 150, the toner image on the cardboard P1 is fixed by heat and pressure onto the cardboard P1, and the cardboard P1 is discharged from the paper discharge section 15. One cycle of image forming processing is thereby performed.

As shown in FIG. 4A, in the fixing device 150, when the cardboard P1 is introduced into the press region where the fixing roll 102 and the belt member 104 make contact with each other, due to the cardboard P1 being pressed by the second press member 124 alone, the pressing force of the second press member 124 is resisted by the strength in the stiffness of the cardboard P1, and the deformation amount is small. The cardboard P1 discharged from the press region is thereby in a substantially flat state, as shown by the solid lines in FIG. 6A, and the curl amount is reduced. Note that due to the narrow configuration of the press width (N2) in the fixing device 150, the conveying speed of the recording paper P is slowed in order to compensate for a reduction in fixing strength.

As a comparative example, if the fixing device 150 were to be employed for fixing normal paper, the curl amount is large due to the absence of the first press member 122 in the press region and strong pressing of the second press member 124 alone. If the fixing device 150 were to be employed for fixing an envelope, due to the envelope being strongly pressed by the second press member 124 in the press region, as shown in FIG. 6B, slip occurs between movement of the top side P2A and the bottom side P2B of the envelope P2 along the direction of travel. This results in a crease Q occurring in the envelope P2 discharged from the press region.

Explanation now follows regarding operation when employing the fixing device 160.

In FIG. 1, when power supply to the image forming apparatus 10 is in the ON-state, the resistance detector 132 of the image forming apparatus 10 (see FIG. 5) detects the resistance value of the fixing device that is installed in the apparatus main body 10A. In this case the fixing device 160 is installed to the apparatus main body 10A, and the selection signal S1 is a signal corresponding to envelopes.

Then, the control section 20 identifies that the fixing device 160 is installed by detecting resistance value R3 with the resistance detector 132 (see FIG. 4B). Moreover, the control section 20 identifies the type of recording paper P to be envelope based on the transmitted selection signal S1 (envelope), compares the selection signal S1 with the identification signal S2, and identifies that both are set at envelope. The control section 20 permits operation of the image forming section 60 and the fixing device 160 (see FIG. 4B), and image forming operation is started in each section of the image forming apparatus 10.

However, in cases in which the type of recording paper P instructed and the type of recording paper P compatible with the fixing device are different from each other, for example, when the selection signal S1 is normal paper or cardboard and the fixing device 160 is in an installed state (the identification signal S2 is envelope), due to the control section 20 banning operation of the image forming section 60 and the fixing device 160, miss-fixing of normal paper and cardboard is avoided.

As shown in FIG. 1, charging, exposing, developing, primary transfer, and secondary transfer are performed similarly to as described above, and the envelope P2 to which the toner image has been transferred (see FIG. 4B) is conveyed towards the fixing device 160 by the conveyor belt 96. In the fixing device 160, the toner image on the envelope P2 is fixed to the envelope P2 by heat and pressure, and the envelope P2 is discharged from the paper discharge section 15. One cycle of image forming processing is thereby performed.

Figure 6C:
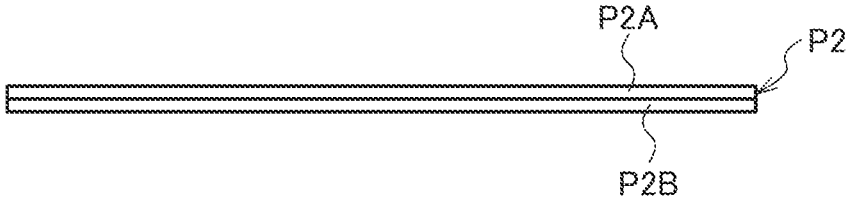
FIG. 6C is a schematic diagram showing a state when an envelope is fixed in an envelope-use fixing device.

As shown in FIG. 4B, in the fixing device 160, when the envelope P2 is introduced into the press region where the fixing roll 102 and the belt member 104 make contact with each other, after the envelope P2 has been pressed by the first press member 122 with biasing force from the spring 164, of smaller biasing force than the spring 126 of the fixing device 100 (see FIG. 3), the envelope P2 is pressed by the second press member 124. When this occurs, due to suppressing slippage along the direction of travel between the top side P2A and the bottom side P2B of the envelope P2, the envelope P2 discharged from the press region is in a substantially flat state, as shown in FIG. 6C, and creasing is reduced.

As a comparative example, if the fixing device 160 were to be employed for fixing normal paper, due to pressing force from the second press member 124 being greater than pressing force from the first press member 122 in the press region, the respective deformation amounts do not cancel each other out, resulting in a large curl amount. If the fixing device 160 were to be employed for fixing of cardboard, due particularly to strong pressing from the first press member 122 in the press region, a large amount of curl results, as shown by the double-dot broken lines in FIG. 6A.

The present invention is not limited by the above exemplary embodiments.

Figure 7:
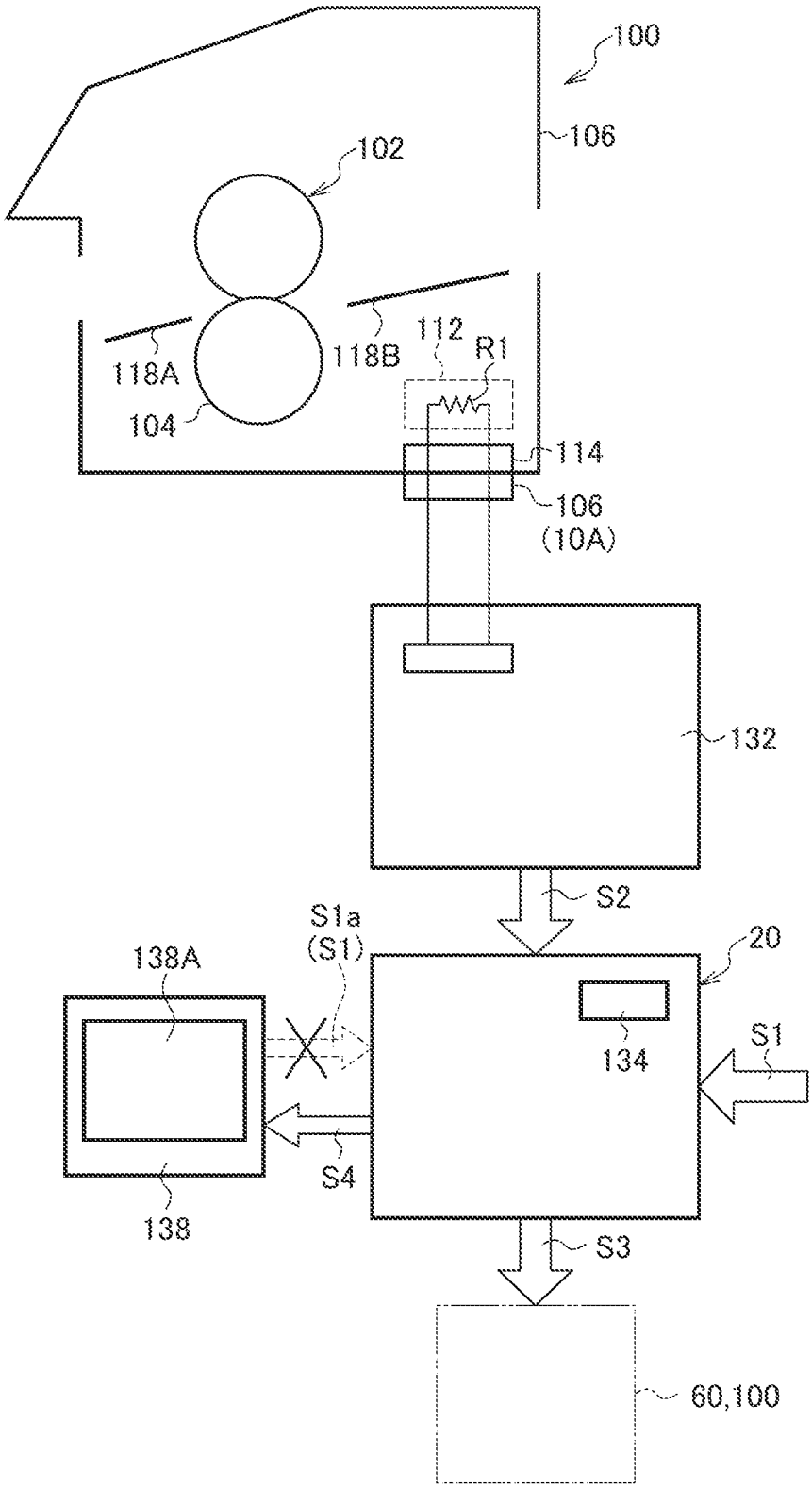
FIG. 7 is a schematic diagram showing a method of identifying the type of the fixing device and changing display contents of an operation panel, according to an exemplary embodiment of the present invention.

As shown in FIG. 7, an operation panel 138, serving as an example of a selection section for displaying the type of recording paper P (name) to a user for selection may further be provided to the apparatus main body 10A (see FIG. 1). In such a configuration, the control section 20, based on the identification signal S2 transmitted from the resistance detector 132, transmits an instruction signal S4 corresponding to the type of recording paper P not banned from being fixed to the operation panel 138. Then, in the operation panel 138, only the type(s) of recording paper P corresponding to the instruction signal S4 are displayed on a display section 138A, and the type(s) of recording paper P that differ from those of the instruction signal S4 are not displayed on the display section 138A. Due thereto, the selection signal S1*a* for the recording paper P for which fixing is banned is no-longer sent to the control section 20 from the operation panel 138, and a user of the image forming apparatus 10 only selects recording paper P matching the installed fixing device. Since recording paper P inappropriate for fixing has been forcibly removed from the selectable options, the image forming apparatus 10 reduces deformation of the recording paper P after fixing from curl and creasing.

Note that in the configuration of FIG. 7, when the selection signal S1 is transmitted to the control section 20 from a personal computer, the control section 20 compares the identification signal S2 and the selection signal S1, so as to transmit the instruction signal S3 to the image forming section 60 and the fixing device (for example to the fixing device 100). Operation of the image forming section 60 and the fixing device 100 is stopped, for example, when the recording paper P is banned from being fixed (cardboard, an envelope). When the selection signal S1 cannot be sent from a personal computer to the control section 20, the control section 20 sends the instruction signal S4 to the operation panel 138 based on the identification signal S2, and only the type(s) of recording paper P corresponding to the instruction signal S4 are displayed on the display section 138A.

The configuration of FIG. 7 may be made such that if the type of recording paper P corresponding to the identification signal S2 and the type of recording paper P corresponding to the selection signal S1 differ from each other, the control section 20 prioritizes the selection signal S1 and displays a message on the display section 138A instructing exchange with an appropriate fixing device. Note that the fixing roll 102 may be configured by a fixing belt heated by an electromagnetic induction method.

Further, the foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing apparatus comprising:

a developer image forming section that is provided in an apparatus main body and forms a developer image on a recording medium;

a fixing section that is provided in the apparatus main body among a plurality of fixing sections, and that fixes the developer image that has been formed on the recording medium by the developer image forming section, each of the plurality of fixing sections allowing at least one type of recording medium to be fixed;

an identification section that is provided for each of the plurality of fixing sections and allows a type of recording medium for being fixed by the fixing section to be identified; and a banning section that is provided in the apparatus main body, identifies the type of recording medium for being fixed by the fixing section that is provided in the apparatus main body, using the identification section and bans image forming on a recording medium that has a different type from the type of recording medium for being fixed by the fixing section.

2. The fixing apparatus of claim 1, further comprising a selection section that displays a type of recording medium to a user for selection, wherein the banning section displays only the type of recording medium for being fixed by the fixing section on the selection section.

3. The fixing apparatus of claim 1, wherein the identification section has a resistor that has a different resistance value, and the banning section has a resistance detection section that detects the resistance value of the resistor.

4. The fixing apparatus of claim 1, wherein the banning section bans the image forming by stopping operation of at least one of the developer image forming section and/or the fixing section.

5. A fixing method comprising:

transmitting to a control section a selection signal related to a type of recording medium selected by an external device or a selection section;

transmitting to the control section an identification signal related to a fixing section provided with a developer image forming section, the fixing section being one fixing section among a plurality of fixing sections, each of the plurality of fixing sections allowing at least one type of recording medium to be fixed, when the type of recording medium corresponding to the selection signal has matched a type of recording medium that is not banned from being fixed by the fixing section corresponding to the identification signal, the control section outputs an instruction signal permitting operation of the developer image forming section and the fixing section; and when the type of recording medium corresponding to the selection signal has not matched a type of recording medium that is not banned from being fixed by the fixing section corresponding to the identification signal, the control section outputs an instruction signal banning operation of at least one of the developer image forming section and/or the fixing section.

6. The fixing method of claim 5, wherein, based on the identification signal:

the control section transmits to the selection section an instruction signal related to a type of recording medium that is not banned from being fixed by the fixing section; and the selection section displays to a user only the type of recording medium corresponding to the instruction signal.

7. An image forming apparatus comprising:

a fixing device that fixes data onto a recording medium and comprises a resistor having a resistance value that identifies the fixing device;

a resistance detector that is electrically coupled to the resistor of the fixing device and detects the resistance value of the resistor; and a controller that receives a selection signal indicating a type of a recording medium, detects whether the fixing device identified by the detected resistance value is compatible with the type of recording medium indicated by the selection signal, and controls the fixing device based on the detection.

8. The image forming apparatus of claim 7, wherein the controller determines whether the type of recording medium is banned from being fixed by the identified fixing device, and when the type is banned, the controller stops the operation of the fixing device.

9. The image forming apparatus of claim 7, wherein the resistance value of the fixing unit uniquely identifies the fixing unit from among a plurality of fixing units.

* * * * *